US005189755A

United States Patent [19]

Yonkers et al.

[11] Patent Number: 5,189,755

[45] Date of Patent: Mar. 2, 1993

[54] WET VACUUM/EXTRACTOR AND CLEANING SOLUTION TANK THEREFOR

[76] Inventors: Robert A. Yonkers, 3565 Apache Ct., Grandville, Mich. 49418; David E. McDowell, 7425 Lime Hollow Dr., S.E., Grand Rapids, Mich. 49506

[21] Appl. No.: 866,893

[22] Filed: Apr. 3, 1992

Related U.S. Application Data

[63] Continuation of Ser. No. 580,809, Sep. 11, 1990, abandoned.

[51] Int. Cl.[5] ..... A47L 7/00

[52] U.S. Cl. ..... 15/321; 15/339; 15/410

[58] Field of Search ..... 15/320, 321, 322, 339, 15/410

[56] References Cited

U.S. PATENT DOCUMENTS

| | | | |
|---|---|---|---|
| 3,072,950 | 1/1963 | Duff | 15/320 |
| 3,262,146 | 7/1966 | Hays | 15/321 |
| 3,343,199 | 9/1967 | Nolte | 15/321 |
| 3,939,515 | 2/1976 | Platek | 15/321 |
| 4,138,760 | 2/1979 | Cadle | 15/321 |
| 4,210,978 | 7/1980 | Johnson | 15/320 |
| 4,329,756 | 5/1982 | Chicoine | 15/321 |
| 4,829,624 | 5/1989 | Lackner | 15/320 |

*Primary Examiner*—Philip R. Coe
*Assistant Examiner*—Terrence R. Till
*Attorney, Agent, or Firm*—Price, Heneveld, Cooper, DeWitt & Litton

[57] ABSTRACT

The specification discloses a wet vacuum/extractor including an add-on liquid dispensing system. A liquid supply tank removably mounts on the vacuum and couples with the vacuum exhaust for momentarily pressurizing the tank to prime the liquid dispensing system. A remote pump is included at the wand handle and is powered by low voltage current from the vacuum.

22 Claims, 4 Drawing Sheets

WET VACUUM/EXTRACTOR AND CLEANING SOLUTION TANK THEREFOR

This is a continuation of application Ser. No. 07/580,809, filed Sep. 11, 1990, and now abandoned.

BACKGROUND OF THE INVENTION

The present invention relates to surface cleaning extractors and wet vacuums. Such extractors are devices which apply a cleaning solution to a surface, such as carpet, upholstery and the like, and then vacuum the solution from the surface, extracting dirt and debris from the surface. Such extractors sometimes use built-in solution tanks and sometimes include attachment means with a long hose so the unit can obtain water from a faucet.

When a built-in solution tank is used, some means for pumping the solution from the tank to a cleaning tool is required. Such pumping function is typically accomplished by an electric pump which draws the solution from the tank and delivers it to the cleaning tool. Often times such pumps are expensive, self-priming units. Alternatively, such pumps can be non-self-priming and positioned such that gravity feeds the solution from the tank, to the pump for priming purposes. The pumping function can also be accomplished by pressurizing the solution tank and forcing, rather than drawing, the solution from the tank.

Both approaches are taught by Hurwitz in U.S. Pat. No. 4,123,818. Hurwitz discloses a closed pressure vessel or reservoir 10 which is pressurized via an air pump 28 for forcing the solution from the reservoir. Alternatively, a liquid pump assembly 128 is provided to drawn the solution from the tank. Inconsistent delivery of solution results from the use of the air pressurizing pump because the pressure within the reservoir decreases as solution leaves the reservoir. Further, subsequent pumping is required to repressurize the reservoir. Alternatively, the use of a liquid pump assembly adds cost and weight to the apparatus.

The various British and U.S. patents to Brazier (British Patents 2,038,168; 1,602,919: 1,602,918 and 1,601,456 and U.S. Pat. Nos. 4,287,636: 4,218,805 and 4,185,354) disclose a floor cleaning system in which the cleaning solution tank is pressurized by the extractor's suction fan exhaust. However, the pressure developed in the solution tank is back pressure to the suction fan and decreases the effective suction of the fan. Alternatively, a larger capacity suction fan assembly is required for a given level of suction when the exhaust is used to pressurize a solution tank for delivering solution to a cleaning tool. This results in a larger, more expensive and heavier suction fan assembly.

The commonly known home shop vacuum is typical of a wet vacuum. Such vacuums have the capability to vacuum liquid from a surface, but were not originally designed with a cleaning solution dispensing function. Accessory kits to add the cleaning solution dispensing function to wet vacuums are now becoming popular. A small solution tank is mounted on the cleaning wand and cleaning solution is drawn by gravity from the tank to the cleaning head for dispensing. Such a system has limitations. The cleaning solution tank is inherently small and limited in capacity, in turn limiting the size of the surface which can be cleaned for each filling of the cleaning solution tank and requiring frequent refillings to clean a room sized area. Also, the solution tank adds weight to the wand and diminishes its maneuverability.

SUMMARY OF THE INVENTION

Such deficiencies and problems are resolved by the present invention wherein a cleaning solution tank is mounted on the vacuum housing, rather than on the cleaning tool, and is connected to the vacuum exhaust so that the exhaust can be used to temporarily pressurize the solution tank for priming the solution delivery system. However, the exhaust is not used to continuously pressurize the solution tank. Thus, back pressure is not created against the suction blower and the vacuum suction effectiveness is not compromised during use. This arrangement allows the use of a generous solution tank to minimize the need for solution refilling. The inherent bulk and limitations of a faucet connected system are avoided. Further, the cleaning tool is not encumbered with the weight and bulk of a cleaning solution tank which has an inherently inadequate capacity. While the invention is especially advantageous when used as an "add-on" tank for a wet vacuum, it is applicable in its broader aspects to fixed solution tank extractors.

In one aspect of the invention, a small pump is located in the tool handle for enhancing and controlling the flow of cleaning solution. In another aspect of the invention, an A/C step-down transformer is provided with a D/C rectifier in the wet vacuum to minimize any chance of a shock hazard by using a low voltage power supply to the pump and to realize the cost advantage of a D/C powered pump.

These and other objects, advantages and features of the present invention will become apparent upon review of the following specification in conjunction with the drawings.

DESCRIPTION OF THE PREFERRED EMBODIMENT

Figure 1:
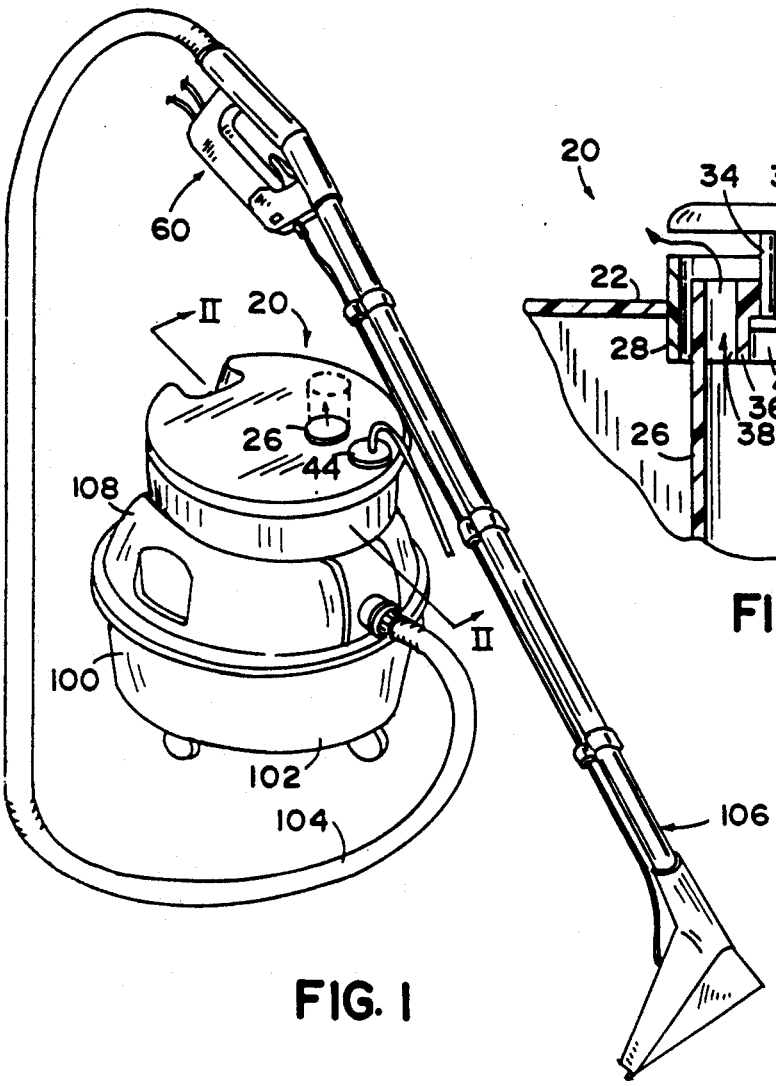
FIG. 1 is a perspective view showing the solution tank and wand handle of the invention mounted on a wet vacuum.

In the preferred embodiment, a cleaning solution tank 20 and cleaning tool handle 60 of the present invention are shown in conjunction with a wet vacuum 100 (FIG. 1). The vacuum 100 includes a recovery tank 102, a suction hose 104, a cleaning tool 106 and a housing 108. A conventional vacuum fan is located within the housing 108 which also has a vacuum fan exhaust outlet 110.

Figure 2:
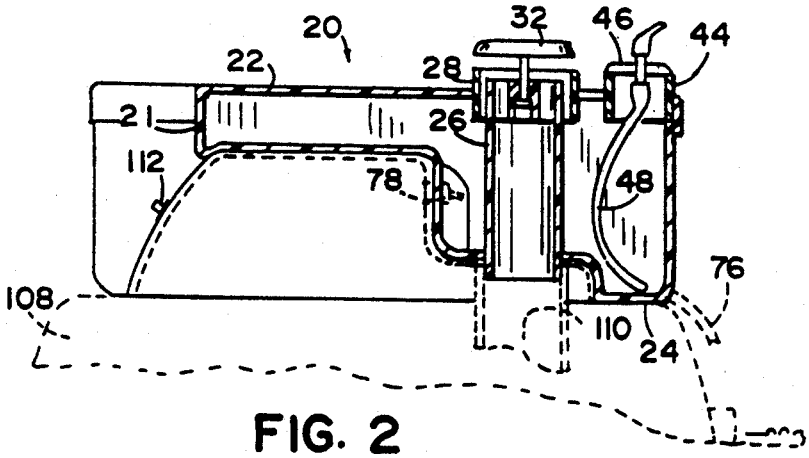
FIG. 2 is a section view at section plane II—II of FIG. 1, showing the solution tank of the invention and showing in phantom the profile of the top of the wet vacuum of FIG. 1.

Tank 20 is seated atop vacuum 100. Tank 20 has a top 22 and a bottom 24 which is configured to couple with housing 108 of vacuum 100 (FIG. 2). Tank 20 is preferably molded of a polystyrene plastic with a notch formed in the back of tank 20 to provide access to power switch 112 of vacuum 100. Handles 21 for ease of removing and carrying tank 20 are provided on each side of tank 20. An exhaust tube 26 is secured to and projects below bottom 24 of tank 20 for coupling with exhaust outlet 110. Exhaust tube 26 also extends upward through tank 20 into an opening in tank top 22 which is defined by an exhaust collar 28. Exhaust collar 28 is secured to top 22 and is concentrically positioned around and spaced from exhaust tube 26 to form an annular air passage 30.

Figure 3:
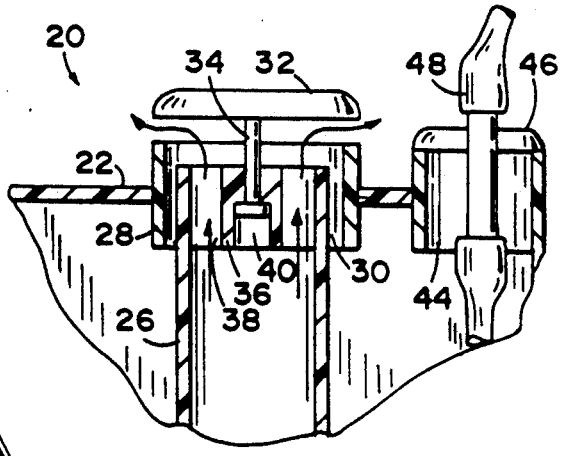
FIG. 3 is a detail of the exhaust valve of the solution tank with the valve in the open position.

A pressure cap 32 is positioned over collar 28 and has a stem 34 projecting downwardly from cap 32 to slidably connect cap 32 with exhaust tube 26 (FIGS. 2 and 3). A stem sleeve 36 is generally centered inside the upper end of exhaust tube 26 for receiving stem 34. Sleeve 36 is attached to tube 26 by three sleeve supports 38. Stem sleeve 36 has a generally centered vertical aperture 40 for slidably receiving ca stem 34 such that the sleeve and stem locate pressure cap 32 in sealing contact with exhaust collar 28 when a downward force is applied to cap 32. Cap stem 34 and stem sleeve 36 also cooperatively engage so that pressure cap 32 cannot be lifted more than a short distance above exhaust collar 28 as shown in FIG. 3.

In the broader aspects of the invention, solution tank 20 can be pressurized with the vacuum exhaust stream merely by covering exhaust collar 28 with the palm of an operator's hand or by the use of a pressure cap 32 which is simply tethered to remain in the vicinity of exhaust collar 28. However, the most preferred structure described above, enhances the performance of the invention by dampening exhaust noise and providing convenience of operation.

Tank 2 is filled with cleaning solution through a fill tube 44, provided in top 22 of tank 20 (FIG. 2). A fill cap 46 positions and secures a solution suction hose 48 which penetrates cap 46 and extends at one end to bottom 24 of tank 20.

Figure 7:
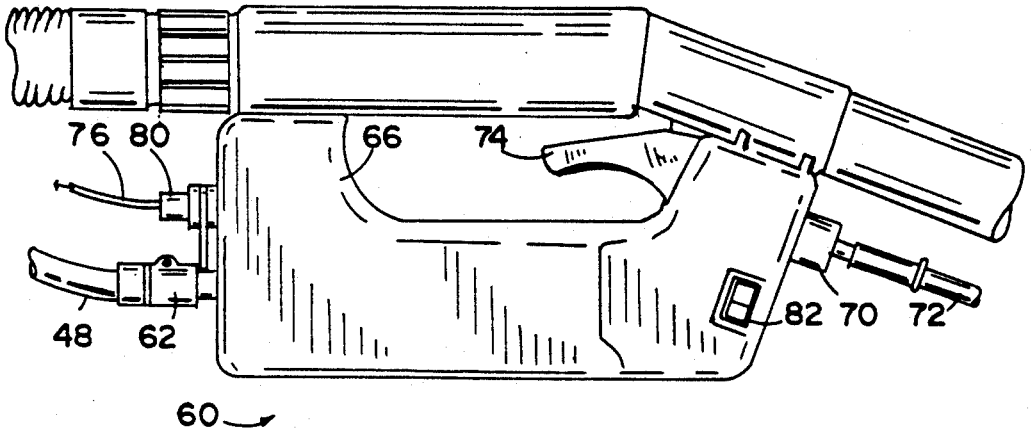
FIG. 7 is a side elevation of the wand handle of the invention.
Figure 8:
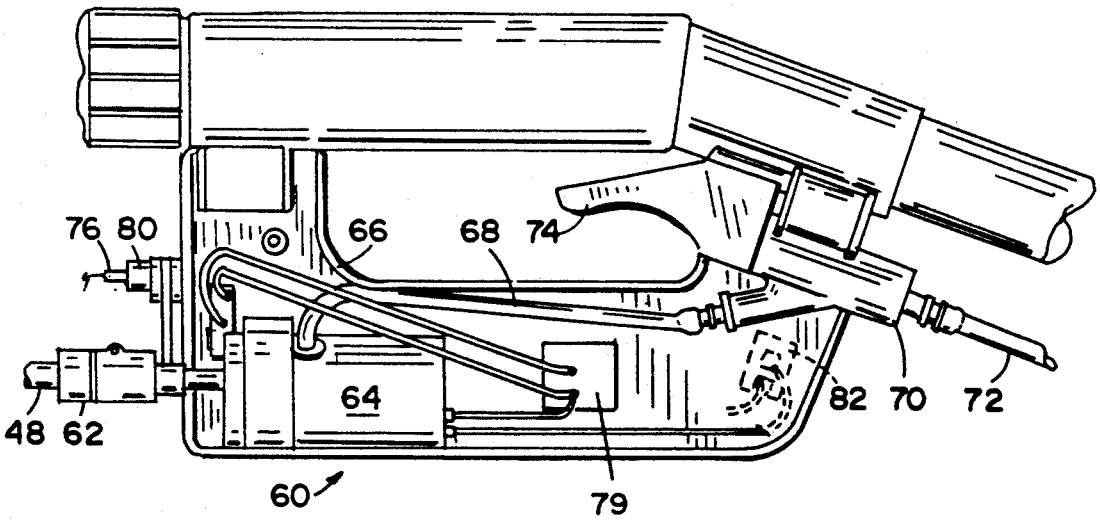
FIG. 8 is the view shown in FIG. 7 with a side cover removed to show the inside of the wand handle.

The other end of suction hose 48 extends to cleaning tool handle 60 where a connector 62 connects hose 48 to a pump assembly 64, housed in handle compartment 66 (FIGS. 7 and 8). Solution which is drawn through suction hose 48 is pumped through a solution feed line 68 to a valve 70 and a dispensing line 72 for dispensing solution independently to a surface. Valve 70 is actuated by a trigger 74 and controls the flow of cleaning solution.

Figure 4:
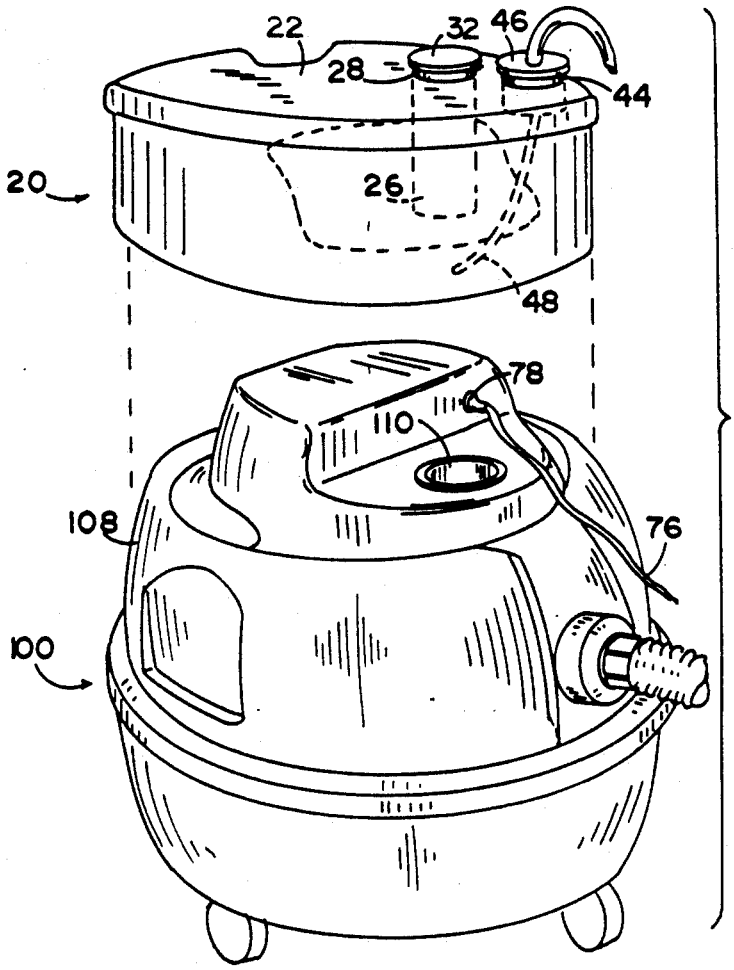
FIG. 4 is a perspective view of the solution tank elevated above the vacuum of FIG. 1.
Figure 5:
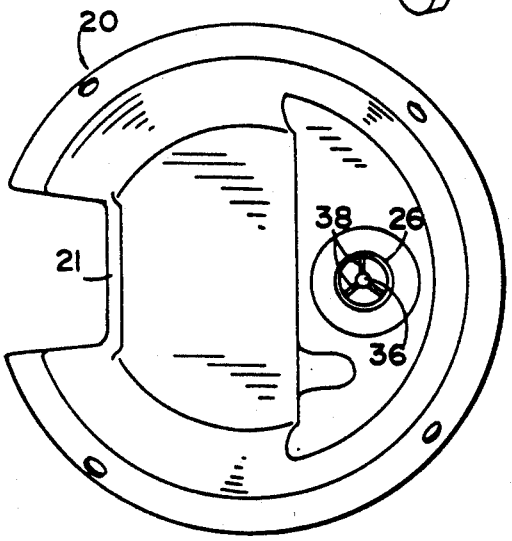
FIG. 5 is a plan view of the solution tank bottom.

Pump 64 is preferably a low voltage, direct current (D/C), centrifugal pump. Power is supplied for pump 64 through a power cord 76 which is connected by a connector 78 at one end to the low voltage side of an alternating current (A/C) step down transformer, contained within housing 108 (FIG. 4). A low voltage D/C rectifier 79 (FIG. 8) is preferably provided at the low voltage side of the transformer to provide a low voltage D/C current for pump 64. The high voltage side of the A/C step down transformer is supplied with household current through the conventional power cord and power switch of wet vacuum 100. The other end of power cord 76 passes through a strain relief 80 and connects to a power switch 82, in handle compartment 66 (FIG. 8). Thus, high voltage remains contained within housing 108 of wet vacuum 100 and only low voltage, less than 35 volts and preferably about 9 volts, is transmitted outside vacuum 100 to pump 64. Further, the performance advantage of using a D/C powered pump 64 is realized by including a D/C rectifier to convert the A/C current to D/C current.

Figure 6:
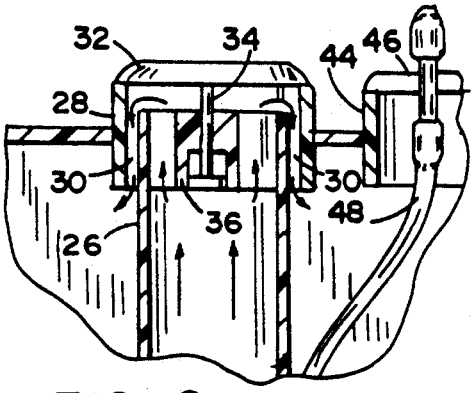
FIG. 6 is a detail of the exhaust valve of the solution tank with the valve in the closed position.

In use, a cleaning solution will typically be mixed in tank 20 by pouring a cleaning solution concentrate into tank 20, through fill tube 44, and then conveniently filling tank 20 with water from a faucet. Tank 20 is easily carried to and placed upon vacuum 100, aligning and inserting the lower end of exhaust tube 26 into exhaust outlet 110 (FIG. 4). Fill cap 46, with suction hose 48 depending therefrom, is fitted to fill tube 44. To commence cleaning, the solution distribution system is primed by turning on vacuum 100 and covering exhaust collar 28 with pressure cap 32 by pressing upon the top of cap 32 with the operator's hand to seat cap 32 down in sealing contact with collar 28 as shown in FIG. 6. As indicated by the arrows in FIG. 6, the exhaust stream from vacuum 100 travels upwardly through exhaust tube 26 toward pressure cap 32 which deflects the exhaust stream through the annular passage 30 and inside tank 20 to pressurize the tank. As an operator uses one hand to pressurize tank 20 by depressing pressure cap 32 into sealing contact with exhaust collar 28, trigger 74 is actuated by use of the operator's other hand to open valve 70 and allow the pressure developed in tank 20 to force cleaning solution through suction hose 48, pump 64, feed line 68, valve 70 and dispensing line 72, thus priming the solution dispensing system (FIGS. 7 and 8). Once the solution dispensing system is primed, pressure cap 32 is released and the vacuum exhaust stream lifts cap 32 to an open position as shown in FIG. 3 so that the exhaust stream travels up through exhaust tube 26 and exhausts through an opening formed between exhaust collar 28 and pressure cap 32. Also after the solution delivery system is primed, cleaning solution is pumped by pump 64 independent of debris extraction by actuating trigger 74 to open valve 70.

Figure 9:
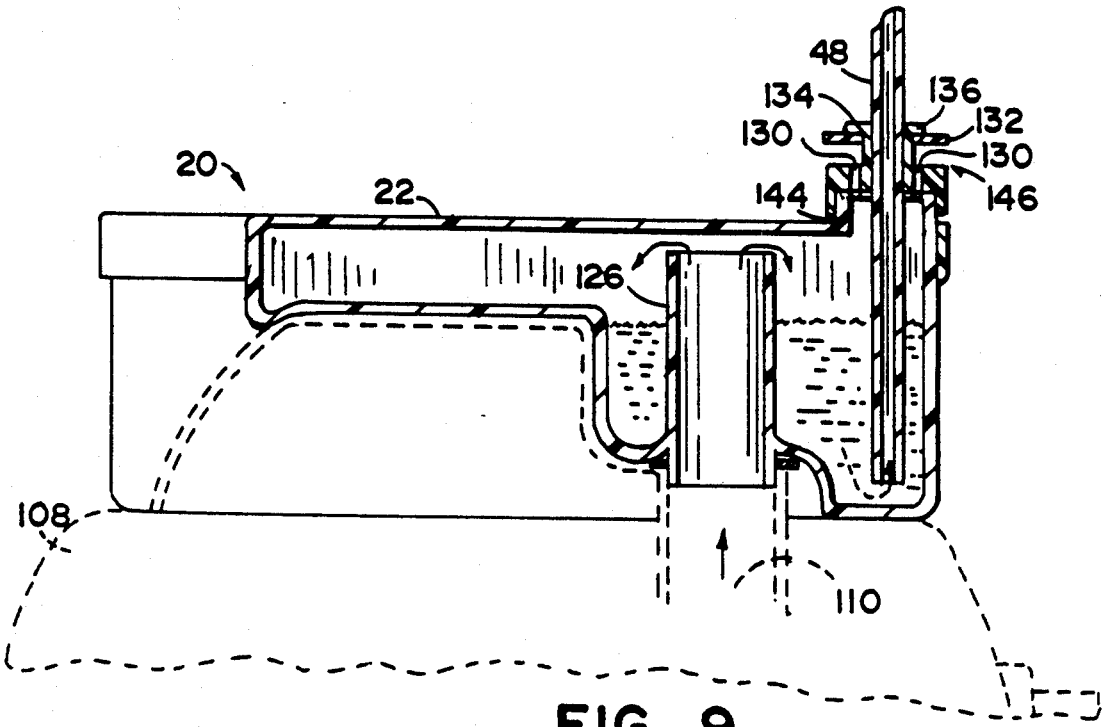
FIG. 9 is the section view of FIG. 2 showing an alternative embodiment of the exhaust valve arrangement.
Figure 10:
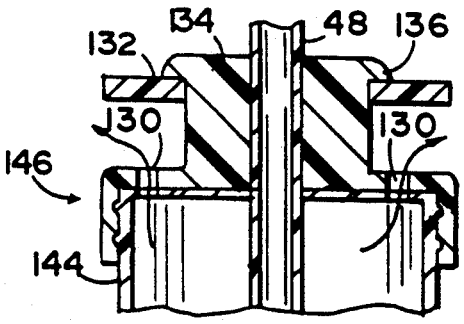
FIG. 10 is a detail of the exhaustive valve of FIG. 9 in the open position.
Figure 11:
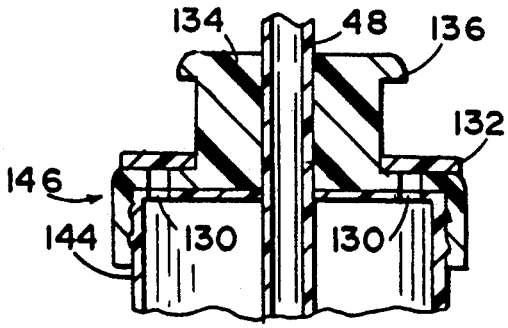
FIG. 11 is a detail of the exhaust valve of FIG. 9 in the closed position.

In an alternative embodiment, as shown in FIGS. 9, 10 and 11, an exhaust tube 126 has an upper end which terminates inside tank 20 near top 22. A fill tube 144 is provided for filling tank 20 and for providing a passage way for exhausting the exhaust stream which travels up through exhaust tube 126 from exhaust outlet 110. A fill cap 146 is also provided and has a generally centered stem 134 which has a generally centered aperture through which one end of solution suction hose 48 extends to the bottom 24 of tank 20. Fill cap 146 also has a series of exhaust passage apertures 130 which are spaced about the periphery of stem 134 and allow the exhaust stream to escape from tank 20. A flat washer-shaped pressure cap 132 is slip fit around cap stem 134 so that pressure cap 132 can freely slide up and down cap stem 134. A flange 136 circumscribes cap stem 134 near the top end of stem 134 to retain pressure cap 132 on stem 134. As with the previously disclosed embodiment, tank 20 can be pressurized for priming the solution dispensing system by exerting a downward force upon pressure cap 132 to position pressure cap 132 in sealing contact with exhaust apertures 130. Conversely, releasing pressure cap 132 will allow the exhaust stream to lift cap 132 until it engages flange 136 and the exhaust stream can flow freely between exhaust apertures 130 and pressure cap 132.

The above description is considered that of the preferred embodiment only. Modifications of the invention will occur to those who make or use the invention. Therefore, it is understood that the embodiment shown in the drawings and described above is merely for illustrative purposes and is not intended to limit the scope of the invention, which is defined by the following claims as interpreted according to the principles of patent law.

The embodiments of the invention in which an exclusive property or privilege is claimed are defined as follows:

1. A wet vacuum/extractor for simultaneously and for independently dispensing cleaning solution to and vacuuming/extracting debris from a surface to be cleaned, comprising:

a recovery tank for receiving debris;

a vacuum fan in fluid communication with said recovery tank for generating a vacuum;

exhaust means in fluid communication with said vacuum fan for exhausting air from said vacuum fan;

a cleaning solution tank having a bottom, for holding cleaning solution;

a cleaning tool for dispensing cleaning solution to a surface to be cleaned, operably connected with said vacuum/extractor;

fluid flow means operably connected between said cleaning solution tank, near said bottom of said cleaning solution tank so that it is below the level of cleaning solution when said tank is filled with same, and said cleaning tool, for delivering cleaning solution from said tank to said cleaning tool, said fluid flow means including a non-self priming pump; and diverting means in fluid communication with said exhaust means and said cleaning solution tank for switchably diverting said exhaust air from said exhaust means to said cleaning solution tank to thereby temporarily pressurize said cleaning solution tank and force cleaning solution through said fluid flow means to prime said fluid flow means with cleaning solution, said diverting means being operatively connected with and diverting said exhaust air into said cleaning solution tank.

2. The wet vacuum/extractor defined by claim 1 wherein said diverting means is a tubular portion of said cleaning solution tank, said tubular portion having a first end operably connected with said exhaust means so that exhaust from said vacuum fan continuously passes through said tubular portion and said tubular portion having a second end which opens into said cleaning solution tank, above the level of liquid contained within said cleaning solution tank and wherein said diverting means further includes a valve on said cleaning solution tank for selectively opening said cleaning solution tank to the atmosphere to allow said exhaust air to exhaust through said tubular portion and out of said cleaning solution tank and for selectively closing said cleaning solution tank from the atmosphere to trap said exhaust air within said cleaning solution tank to thereby pressurize said cleaning solution tank, force cleaning solution from said cleaning solution tank through said fluid flow means, and prime said fluid flow means.

3. The wet vacuum/extractor defined by claim 2 wherein said cleaning solution tank has a top, said cleaning solution tank includes means defining an orifice in said top and said second end of said tubular portion aligns with said orifice.

4. The wet vacuum/extractor defined by claim 2 wherein:

said fluid flow means comprises a suction hose, said hose having one end extending into said cleaning solution tank; and said cleaning solution tank is a closed cell having filling means and a top.

5. The wet vacuum/extractor defined by claim 4 wherein said filling means comprises a fill tube and a fill cap, said tube defining an aperture in said top.

6. A wet vacuum/extractor defined by claim 5 wherein said fill cap comprises a body portion adapted to removably fit in sealing contact with said fill tube and having an aperture for receiving said suction hose, whereby said suction hose extends through said fill cap, into said cleaning solution tank.

7. The wet vacuum/extractor defined by claim 5 wherein said fill cap comprises:

a body portion, said body portion being adapted to removably fit to said fill tube and having a generally planar top surface;

a stem, said stem projecting outwardly from said top surface, being generally centered thereon and having a terminal end away from said top surface;

air passage means;

valve means for selectively opening and closing said air passage means;

an aperture extending through said stem and said cap for receiving said suction hose and whereby said suction hose extends into said tank.

8. The wet vacuum/extractor defined by claim 7 wherein:

said air passage means comprises at least one orifice in said top surface between said stem and the parameter of said cap; and said valve means is a flat washer shaped member, said member being adapted to be slidably mounted to said stem so that said member can be positioned in sealing contact with said air passage means to close said air passage means and so that said member can be positioned near said terminal end of said stem to open said air passage means.

9. The wet vacuum/extractor defined by claim 2 wherein said cleaning tool has a handle and said fluid flow means includes a pump mounted within said handle.

10. The wet vacuum/extractor defined by claim 9 wherein said pump is electrically powered, said wet vacuum/extractor includes a low voltage power source for powering said pump, and said pump is electrically connected with said low voltage power source.

11. The wet vacuum/extractor defined by claim 10 wherein said low voltage power source supplies an alternating current and a rectifier for converting said alternating current to direct current is connected between said low voltage power source and said pump.

12. The wet vacuum/extractor defined by claim 1 wherein said cleaning solution tank;

is a closed cell having filling means and connecting means for connecting with said fluid flow means;

includes said diverting means; and includes valve means for selectively opening the interior of said cleaning solution tank to the atmosphere and closing said interior from the atmosphere so that said cleaning solution tank is pressurized by exhaust air to force cleaning solution through said fluid flow means for priming said fluid flow means.

13. The wet vacuum/extractor defined by claim 12 wherein said cleaning tool has a handle and said fluid flow means includes a pump mounted within said handle, said pump being primed when said diverting means is activated to divert exhaust air to pressurize said cleaning solution tank.

14. The wet vacuum/extractor defined by claim 13 wherein:

said pump is electrically powered;

said wet vacuum/extractor further includes a low voltage, alternating current power source for powering said pump;

said pump is electrically connected with said low voltage power supply; and a rectifier for converting said alternating current to direct current is connected between said low voltage power source and said pump.

15. A wet vacuum/extractor comprising:

a recovery tank for receiving debris;

a vacuum fan in fluid communication with said recovery tank for generating a vacuum;

exhaust means in fluid communication with said vacuum fan for exhausting air from said vacuum fan;

a cleaning solution tank for holding cleaning solution, said cleaning solution tank having a top, said top having an orifice, said orifice being defined by a cylindrical collar;

a cleaning tool operably connected with said vacuum/extractor;

fluid flow means connected between said cleaning solution tank and said cleaning tool for delivering cleaning solution from said tank to said cleaning tool; and diverting means in fluid communication with said exhaust means and said cleaning solution tank for switchably diverting said exhaust air from said exhaust means to said cleaning solution tank to thereby temporarily pressurize said cleaning solution tank and force cleaning solution through said fluid flow means, said diverting means including a tubular portion of said cleaning solution tank and a valve on said cleaning solution tank for selectively opening said cleaning solution tank to the atmosphere to allow said exhaust air to exhaust through said tubular portion and out of said cleaning solution tank and for selectively closing said cleaning solution tank from the atmosphere to trap said exhaust air within said cleaning solution tank to thereby pressurize said cleaning solution tank, said tubular portion having a first end connected with said exhaust means and having a second end which opens into said cleaning solution tank above the level of liquid held by said cleaning solution tank, aligns with said orifice, and extends into said collar defining an annular air passage between said collar and said second end.

16. The wet vacuum/extractor defined by claim 15 wherein said means defining said orifice includes a cap for covering said collar in sealing contact and includes mounting means for positioning said cap in sealing contact with said collar in a closed position and positioning said cap away from said collar in an open position.

17. An add-on cleaning solution dispensing assembly for a wet vacuum having a debris recovery tank and an exhaust air outlet, wherein said add on assembly comprises:

a cleaning solution tank for holding cleaning solution, said cleaning solution tank having a bottom;

means for removably mounting said tank on the wet vacuum;

diverting means for operatively connecting the exhaust air outlet with said cleaning solution tank so that exhaust air is directed from said exhaust air outlet into said cleaning solution tank for temporarily pressurizing said cleaning solution tank; and dispensing means connected with said cleaning solution tank for dispensing cleaning solution to a surface for cleaning, said dispensing means including a cleaning solution inlet positioned near said bottom of said cleaning solution tank so that said inlet is immersed in cleaning solution, said cleaning solution being forced through said inlet and said dispensing means when said cleaning solution tank is pressurized.

18. The assembly defined by claim 17 wherein said diverting means is a conduit having a first end adapted to releasably couple with the exhaust air outlet so that exhaust air from the vacuum passes through said conduit and having a second end which opens into said cleaning solution tank, above the level of any cleaning solution contained within said cleaning solution tank.

19. The assembly defined by claim 18 wherein said cleaning solution tank is a closed cell having filling means and connecting means for connecting with said dispensing means and wherein said diverting means includes valve means on said cleaning solution tank for selectively opening the interior of said cleaning solution tank to the atmosphere and closing said interior from the atmosphere, said valve means being located above the level of any cleaning solution contained within said tank.

20. The assembly defined by claim 19 wherein said dispensing means further includes a handle and a pump mounted within said handle, said pump being operatively connected to said dispensing means for pumping cleaning solution from said cleaning solution tank to a surface.

21. The assembly defined by claim 20 further including a low voltage power source for powering said pump, said pump being electrically powered and 22. A wet vacuum comprising:

a tank having a bottom for holding cleaning solution;

dispensing means connected with said tank, near said bottom of said tank and immersed in cleaning solution held by said tank, for dispensing cleaning solution to a surface for cleaning, said dispensing means including a low voltage pump in fluid communication between said tank and the surface to be cleaned, for pumping cleaning solution from said tank to the surface;

a low voltage power source electrically connected with said pump; and priming means separate from said pump for priming said pump, said priming means including a conduit having a first end connected with a vacuum air outlet of the wet vacuum and a second end connected with said tank at a location above the level of solution held by said tank so that exhaust air continuously passes through said conduit and said tank and including a valve for temporarily blocking the flow of exhaust air so that said tank is temporarily pressurized by the exhaust air and cleaning solution is forced from said tank, through at least a portion of said dispensing means, to said pump for priming said pump.

* * * * *

UNITED STATES PATENT AND TRADEMARK OFFICE

CERTIFICATE OF CORRECTION

PATENT NO. : 5,189,755

DATED : March 2, 1993

INVENTOR(S) : Robert A. Yonkers et al.

It is certified that error appears in the above-indentified patent and that said Letters Patent is hereby corrected as shown below:

Column 3, Line 27:

"ca stem" should be --cap stem--

Column 3, Line 43:

"Tank 2" should be --Tank 20--

Column 8, Line 42, Claim 21:

After "powered and" insert --electrically connected with said low voltage power source.--

Signed and Sealed this

Thirty-first Day of May, 1994

Bruce Lehman

*Attest:*

BRUCE LEHMAN

*Attesting Officer*

*Commissioner of Patents and Trademarks*